US006283001B1

(12) United States Patent
Schultes

(10) Patent No.: US 6,283,001 B1
(45) Date of Patent: Sep. 4, 2001

(54) FACILITY FOR CUTTING FABRIC, FACILITY FOR FEEDING FABRIC AND METHOD FOR CUTTING FABRIC

(75) Inventor: Robert Schultes, Puchheim (DE)

(73) Assignee: Gpv mbH, Meerbusch (DE)

( * ) Notice: Subject to any disclaimer, the term of this patent is extended or adjusted under 35 U.S.C. 154(b) by 0 days.

(21) Appl. No.: 09/331,574

(22) PCT Filed: Nov. 20, 1997

(86) PCT No.: PCT/EP97/06500

§ 371 Date: Aug. 9, 1999

§ 102(e) Date: Aug. 9, 1999

(87) PCT Pub. No.: WO98/29324

PCT Pub. Date: Jul. 9, 1998

(30) Foreign Application Priority Data

Dec. 31, 1996 (DE) ..... 196 54 796

(51) Int. Cl.[7] ..... B26D 7/00

(52) U.S. Cl. ..... 83/39; 83/22; 83/56; 83/72; 83/76.8; 83/100; 83/155; 83/209; 83/370; 83/365; 83/367; 83/422; 83/614; 83/937; 83/650

(58) Field of Search ..... 83/13, 23, 52, 83/72, 76.8, 22, 76.9, 27, 937, 650, 39, 42, 56, 86, 100, 104, 109, 175, 206, 208, 209, 225, 240, 263, 360, 364, 365, 367, 368, 369, 370, 422, 452, 614, 155, 151

(56) References Cited

U.S. PATENT DOCUMENTS

| | | | | |
|---|---|---|---|---|
| 3,701,299 | * | 10/1972 | Stumpf | 83/72 |
| 3,823,629 | * | 7/1974 | Bleimund | 83/94 |
| 3,831,472 | | 8/1974 | Sasaki | 83/92 |
| 4,476,756 | * | 10/1984 | Pearl et al. | 83/422 |
| 4,493,460 | * | 1/1985 | Buss | 83/650 X |
| 4,514,246 | * | 4/1985 | Forrer et al. | 83/94 X |
| 5,172,326 | | 12/1992 | Campbell, Jr. et al. | 364/470 |
| 5,189,934 | * | 3/1993 | Davidson et al. | 83/153 |
| 5,193,424 | | 3/1993 | Minichshofer et al. | 83/75 |
| 5,463,921 | * | 11/1995 | Bellio et al. | 83/151 |

FOREIGN PATENT DOCUMENTS

| | | |
|---|---|---|
| 196 06 484 | 8/1996 | (DE) . |
| 0 578 903 | 1/1994 | (EP) . |
| 0 589 089 | 3/1994 | (EP) . |
| 0 668 231 | 8/1995 | (EP) . |
| 2 579 963 | 10/1986 | (FR) . |
| 2 731 595 | 9/1996 | (FR) . |

* cited by examiner

*Primary Examiner*—Boyer Ashley
(74) *Attorney, Agent, or Firm*—Thomas Hooker, P.C.

(57) ABSTRACT

An apparatus for cutting fabric includes at least one fabric wind-off device (1, 1') for one fabric bolt (7), a conveyor belt (5) for conveying the unwound fabric, and a cutting device (3) which cuts a piece of fabric to a given shape from the length of fabric deposited on the conveyor belt (5). Said conveyor belt (5) extends without interruption from at least that point where the fabric is deposited by the wind-off device (1, 1') to the working area of the said cutting device (3). The wind-off device (1, 1') places the length of fabric directly onto the conveyor belt (5) or onto one of more lengths of fabric already deposited on the said conveyor belt. An apparatus control automatically feeds the unwound fabric to the cutting device and directs the cutting of the unwound fabric by the cutting device.

27 Claims, 8 Drawing Sheets

FACILITY FOR CUTTING FABRIC, FACILITY FOR FEEDING FABRIC AND METHOD FOR CUTTING FABRIC

FIELD OF THE INVENTION

The invention concerns a custom cutting apparatus for cutting fabric, a device for feeding said fabric to cutting apparatus and a process for the use of such equipment.

BACKGROUND OF THE INVENTION

A device for the feed of fabric to a textile machine has been disclosed by EP-A-0 589 089. The device is designed as a trough with a driven surface, so that fabric rolls lying in the trough are set into rotation by friction and thereby unwind themselves. The so unwound fabric length is laid upon a conveyor belt assigned to said unwinder and by means of this conveyor belt is transferred to another additional and separate conveyor belt which is dedicated to feeding a cutting machine. These operations, taken all together, provide the assembly with the name of a feeding device.

Conventional equipment of this kind has not proven itself as optimal, since it is difficult for such equipment to bring out a fold-free, straight line issue of the fabric. Furthermore, the exactness with which the custom cutting of said fabric is carried out is limited.

SUMMARY OF THE INVENTION

The purpose of the present invention is to make available a custom cutting apparatus, which overcomes the above named deficiencies of the existing state of the technology. This purpose includes the formulation of a process for said custom cutting, corresponding to the operation of said feeder and cutting apparatus. The invention further provides an improved fabric feeding device.

This purpose will be achieved by a custom cutting apparatus which exhibits the following:

at least one fabric unwinding device for a fabric roll, a conveyor belt for the transport of the unwound fabric, a custom cutting apparatus which cuts the fabric while said fabric is still on the transport band, whereby the transport band extends at least from the position where the fabric is deposited by the unwinder device up to the operational area of the custom cutter and the fabric band lies directly on the conveyor belt or on one or more thereupon lying fabric bands.

Because of the use of the conveyor belt, with a through movement, the control of the fabric custom cutting apparatus has available very precise data in regard to the position of the fabric in the operational zone of the custom cutter. In addition, this movement eases the issuing of fold-free and straight line character of the fabric. Consequently, the pattern can be more exactly positioned in relation to the material, so that the custom cutting can be done with greater precision.

In the state of the technology up to now, the cutting off of the fabric at the end of a pattern or at the fabric roll end, is, in general, done by the said cutting apparatus. In yet another embodiment of the present invention, the fabric unwinder device is equipped with a fabric cut-off device. In the case of several unwinding devices, these are each advantageously and respectively equipped with a fabric cut-off device. These measures, on the basis of the increased precision of the conveying belt position, enable the cut-off operations at the pattern, or end of a fabric roll, to be carried out at the respective unwinding device. This increases the operational speed, since it makes possible the relieving of the custom-cutting apparatus from the cutoff operation, and provides a faster change of the fabric roll. The custom cutting apparatus permits a simple removal of fabric ends, although not cut off at the custom cutter, but at the unwinding device.

Fundamentally, these remainder pieces can also run on with the conveyor belt. The cutoff fabric remainders have, usually, a length of 0.2 m to 1 m and can be rolled up and discarded by an operating person or by the custom cutter apparatus (see below).

In yet another embodiment of the present invention, the fabric unwind device is equipped with fabric stretch loading apparatus or fabric tension loading apparatus, which holds the fabric firmly upon cutoff with the fabric cutoff device.

In order to attain an especially fast exchange of the fabric to be cut, the fabric unwinding device, of which there may be several, is so designed, that it can, in a self-acting manner, rewind the remainders on the fabric rolls (or on a winding shell). This enables an especially fast change-over to a new fabric roll. The cutoff of the fabric can, as already noted, be exercised for two different reasons. The first possible reason is the reaching of the end of a pattern cut, when the subsequent pattern must cut from a different material, i.e. a different color or a different pattern. The necessary cutoff signal emanates from the control of the fabric feed device, which possesses data on the pattern which is to be used. The second reason lies in the reaching of the end of the material which was originally in the fabric roll.

In yet another embodiment of the present invention, the material unwinding device, of which there may be more than one, is equipped with a material end sensor or fabric end sensor, which detects the approach or the reaching of the fabric end, advantageously upon the sensing of the complete or nearly complete unwinding of the fabric roll. Differently, in yet another embodiment of the present invention, the fabric end sensor is designed from a light-relay, through the beam of which the fabric band is run, proximal to the unwinder. The control of the cutting is stopped and simultaneously, the unwinding is interrupted as soon as the end of the fabric strip is recognized. With this action cutoff is instituted for the fabric. Because of the traveling conveyor belt, the control senses, with great exactness, the arrival of the fabric end at the custom cutter apparatus and can, therefore, synchronize the cutting operation accordingly.

The advantages of the invention can be especially effectively put to use, when—in yet another embodiment of the present invention—two or more unwinding devices are provided, preferably one unwinding device following the other winding device. This arrangement, achieves, for instance, a substantial reduction of the idle time of the custom cutting apparatus and besides, enables a significant increase of the effective speed of operation is possible. As has been explained above, there is an obvious requirement that a fabric roll must be changed frequently, because of necessary switches in color or pattern specifications.

Yet another embodiment of the present invention provides for such changes in the fabric roll, practically without interruption in the operation, since after the cutoff of a fabric with the existing cutoff device for the respective fabric roll, the control of the equipment immediately acts so that the remnant fabric roll is rewound and the unwinding of fabric from other textile rolls is carried out subsequently so that the layout of the material on the transport belt and the conveyance of the "new" fabric to the custom cutting device is immediately effected.

Because of the continuous conveyor belt, the arrival of the fabric band end at the custom cutter can be precisely calculated. Yet another embodiment of the present invention permits an interruption of the control of the custom cutter process at the latest, when the calculated arrival of the said fabric band end at the custom cutter takes place and sets the control back in operation by a "Start-again" signal upon the arrival of a subsequent fabric band. The computing of the arrival time is carried out advantageously with reference to the speed of the conveyor belt and the difference in distance between the fabric cutoff device or the fabric-end sensor and the custom cutter. The fabric end sensor can, because of the use of the continuous conveyor belt be disposed proximally to the unwinding device (and not the custom cutter, although this would also be possible and would lead to a self actuating recognition of a fabric end.) The control can also automatically compute the arrival time of the lead edge of another fabric band at the custom cutter, after the said restart of the unwinder. The valid basis for this is again the continuity of the conveyor belt.

Alternatively, the determination of the arrival of a fabric band in the near proximity to the operation area can be done without being on the basis of a computation, but by direct detection of the leading edge of said fabric band. This can be accomplished, for instance, by optical means. For this purpose, the conveyor belt can be made in a specific color, which contrasts itself from the generally used fabric colors. An optical sensor is sensitive to the light reflected from the conveyor belt (which light necessarily has the color of the conveyor belt). Upon the arrival of the leading edge of the fabric, (which has a different color) the intensity of the detected reflected light is diminished, whereupon the arrival signal has been received. Another possibility of the recognition of the fabric rests upon an optical difference in distance measurement. The vertical spatial interval between an instrument above the conveyor belt and its visible surface diminishes itself, namely when fabric lies on the conveyor belt. This diminishing of the vertical interval permits the detection of the presence of fabric. The measurement rests, for instance, on the fact that light is focused on the conveyor belt and the reflected light from that surface is detected. The presence of the fabric implies, that the focus point lies under the reflecting surface (here the fabric), which condition manifests itself in an obvious lessening of the detected reflected light intensity. Both measuring methods can be used alternatively or in combination.

In yet another embodiment of the present invention, on the basis of this detection, a self actuated zero point reset for the pattern cutter in the moving direction of the fabric band occurs for the next-in-sequence, custom cutting procedure. This zero point lies in the longitudinal direction at a prespecified distance (for instance, 2 cm) from the fabric band leading edge, and is offset toward the center of the fabric band. Along with the zero-point setting, a restart signal for the cutting procedure could also advantageously be made.

A selvedge for fabric rolls of differing width, found at a right angle, or hereinafter "cross", to the direction of conveyor travel must be considered when setting the zero point. The selvedge is that fabric edge area which differs from the remainder of the material in color and/or pattern. More exactly said, the cross zero point must be set at a specified distance from the inner edge of the selvedge toward the center of the fabric band, i.e. remote from the edges. The detection of the inner edge of the selvedge can fundamentally be done automatically by optical means. Preferred is, however, a half-automatic setting of the cross zero point in yet another embodiment of the present invention. This is based on an automatic fabric roll follower guide, which compensates for unequal windings of the fabric across the band. At the start of an unwinding for a new roll, an operator defines the position of the cross-zero point relative to the edge of the fabric. If the cross zero point should lie, for example, 1 cm within the inner edge of the selvedge, then the operator, in case of a 2 cm selvedge, sets the cross zero point 3 cm within the actual fabric edge.

The roll follower guide transversely slides the fabric roll automatically during the unwinding in such a manner, that the cross zero point comes to lie at an established cross position of the conveyor belt (the cross-zero point position). In yet another embodiment of the present invention, the determination of the fabric band edge position, which is necessary for the described action, is carried out by a fabric band edge sensor with an optical light relay system. Such a system would encompass one or more light sources which directly illuminate the fabric edge after the unrolling and one or more sensors for the spatial detection of the light interrupted by the fabric and/or the light falling on the fabric band.

In the case of the fabric custom cutting, in accord with the invention, the control, because of the positioning of the conveyor belt, can precisely predetermine whether a pattern to be cut exceeds the available length of the remaining fabric. In accord with yet another embodiment of the present invention, it is even possible, that the control selects only those patterns for a pattern, which, before running out of fabric, can be completely cut out. The control stores in memory those pattern cutouts, which cannot be completely cutout and then permits, that these cutouts are automatically called back into action after operation begins with new (and sufficient) fabric. From the standpoint of control technology, it is possible as shown in yet another embodiment of the present invention, that in case a fabric roll reaches an end at a pattern cutter, this will be cut as determined by the control. Such patterns as could not be cut from said roll completely, are automatically recognized and after automatic recognition of the zero point in the direction of the conveyor belt travel, will be cut out of the next fabric rolls. These measures enable a substantial reduction of the spoilage.

The single cutouts must frequently be provided with additional seams and quilting. This can be the case, for example, in upholstery covering, in which the cover folds are made by the sewing of the single patterns before the complete sewing together of the covering is done. In this case, it is advantageous that the patterns are provided with markings, along which the seam or quilt lines can be set. In order not to have to mark each cutout, these markings were advantageously placed on the not yet cut fabric band. For the later processing of the cut-outs, in general, markings must be made on the fabric. For instance, such markings show where later quilting is to be made.

In yet another embodiment of the present invention, for this purpose a marking device has been provided. In the state of the technology, one uses for this purpose a marking head (that is, a spray head) which is installed on the custom cutting apparatus and, indeed more exactly, on the available, bidirectionally movable support which also carries the cutting head of the custom cutting apparatus. The work-up of the fabric is done in the manner of the state of the technology, in general so, that first, by an appropriate procedure of the supports, the necessary markings on the fabric are applied. When that is accomplished, once again, by corresponding movements of the support, the required fabric cutting can proceed.

Alternatively, in yet another embodiment of the present invention a controllable marking apparatus, separately placed away from the custom cutting apparatus and independent thereof, is provided. The cutting and the marking are executed simultaneously. Advantageously, the marking apparatus is located between the unwinding device and the cutting apparatus. By marking the fabric directly after the unwinding from the fabric rolls, the fabric bands come to the cutting apparatus in a prepared state. Since the cutting apparatus now serves only the one cutting function, the operational speed is increased by a factor of 2.

In a case of disturbance with the cutting apparatus or the marking apparatus, a custom cutting machine of the state of the technology must, in general, be brought to a stand still, until the difficulty is corrected. In order to avoid production down-time of this kind, by means of an improvement of the above described system, in yet another embodiment of the present invention, the marking apparatus is equipped with a custom cutting means (for example) a cutting head, and/or the custom cutting apparatus is provided with a means for marking (for instance, a marking head). The control of the equipment is so designed, that at an emergency-run operation—at what would be a shut down for conventionally operating cutting or marking means—in accord with the present invention, custom cutting is possible with the cutting means placed on the marking equipment, or, in reverse, marking continues with the marking means located on the cutting apparatus. Further, roll exchange can be carried out simultaneously. In the case of a complete breakdown of either of the two apparatuses, a more extensive emergency-run operation is foreseen, in which both functions are taken over by the non-disabled apparatus (i.e. custom cutting and marking). In the first mentioned case there is effected a continuation of operation with simultaneous cutting and marking without loss of time. In the second case, what occurs is a non-simultaneous cutting and marking, which allows continued operation at perhaps half the speed of the normal operating rate.

The unwinding of the fabric and its conveyance on the conveyor belt can be done continuously or discontinuously. In the first case, the fabric is drawn from the roll without interruption or delay and during its movement, is cut and, if necessary, marked. Control-wise, however, a forward impulse movement is simpler, in which the unwinding device and the conveyor belt are at times held back for a cutting of a "cutting window" and, if necessary, for the marking of a "marking window".

In yet another embodiment of the present invention, the fabric custom cutting apparatus exhibits a marking head, which is movable in the transport direction of the conveyor belt or at right angles thereto. This marking head can be outfitted with a spray device, which applies line-like markings on the fabric band. In this way, dry powder can be ejected thereon, which, after the further work-up of the material can be brushed away. The spray, or ejected substance can also be of a retentive nature, such as a dye, which, without the aid of technical means (fluorescent lamps), is invisible. In the case of another preferred embodiment, the marking apparatus is formed from a marking head, which, in similar manner to a plotter, applies the markings by means of a movable vertical rod moving along the lines to be marked. The rods can be chalk pieces or other customary marking means. In this way, a single rod can be employed. Even a supply magazine can be provided, out of which the marking head can select a rod. The latter form has the advantage, that, first, the rods are exchangeable upon wear without long resetting periods, and second, several rods for varied colored markings are immediately accessible to the marking head. The movement of the marking head is, advantageously, regulated by a control unit which possesses a microprocessor. This control can be, for instance, from a tool machine issue such as the well known CNC or DNC Control units.

The input quantity of the control includes the placement of the markings to be made on the individual patterns as well as the arrangement of the pattern. In order to be able to load in these data, the said control possesses an interface, to which is connected either:

- a central control unit for the regulation of the fabric guidance formed from the unwinding device and the conveyor belt and the custom cutting apparatus, or
- by means of which central control the data from another computer could be taken over, for instance, the control of the cutter apparatus.

Compatible data formats are preferred, such as in textile work, the customary formats, *.DXF AAMA or formats such as ISO 6983, wherein the data, in general, are produced with the aid of CAD-systems. A matching to each optional data format is possible. The control of the equipment can be the proprietary format of another machine manufacturer, such as, the proprietary format of the French firm "Lectra Systems", which can be installed and worked with. The program for the control of the marking head can either be input through the interface for the location data of the markings, or be input to a stable memory, for instance an EPROM or even to an electrical erasable and rewriteable EEPROM.

In yet another embodiment of the present invention, the custom cutting apparatus exhibits a cutting head, which is movable in the cross direction and, if required, in the direction of conveyor belt travel and the position of which as well as the cutting activity is controllable from the control of the general equipment. The cutting head control is advantageously designed in the same way as the above described marking head control. The two controls can use one and the same or separate microprocessors. Further the two head control components can be the control of the entire fabric cutting equipment, which possesses a single common microprocessor.

The cutting head can possess a cutting knife, which, for instance, is designed as an electronically driven circular knife. In other embodiments, the cutting knife is designed as a pinion cutter, which advantageously is activated supersonically, whereby the assurance is given that even in the case of fast forward movement, the cutting force is vertical to the fabric band. The cutting head can also be built as a die, which stamps the patterns out of the fabric band.

In a preferred embodiment, the cutting head is a laser beam cutting head. This type of cutting head possesses a laser beam source and a corresponding focusing optical system, which focuses the laser beam on the fabric band. To avoid undesirable oxidation, an additional protective gas jet can be provided, which pushes away from the cutting position the oxygen containing air by means of inert gases, i.e. nitrogen or other inactive gases. Especially, where artificial fiber containing textiles are concerned, a fume removal system can be provided, which, during the cutting, sucks away the vaporized substances in order to uphold the required working place environmental regulations (MAK-values).

Finally, the cutting head can also fulfill its function as a water stream, which exhibits a water jet, from which a high pressure water stream issues for cutting the fabric. In this case, the custom cutting apparatus possesses on the side remote from the cutting head, an appropriate collection system for the cutting water stream. An advantageous arrangement is one of the above mentioned mechanical cutting or stamping methods combined with a laser beam cutting device or with a high pressure water jet custom cutting apparatus.

In order to cut out several similar patterns in a single work operation, it is known in the state of the technology to lay several layers of fabric bands, one on top of the other. These laminated arrangements of fabric are brought to the cutting apparatus, and with one penetrating cut, are all custom cut together (see EP-A-0 589 091 referred to previously). With the conventional marking apparatuses (see DE-U-295 03 230) only the top layer of this multiple layered fabric structure can be so marked.

In yet another embodiment of the present invention, the fabric cutting apparatus is so designed, that on the conveyor belt, two or more layers of fabric can be laid out on top of one another. For this purpose, a corresponding number of fabric unwinding devices are used. Because of the continuously moving conveyor belt, the fabric bands can be very precisely positioned over one another.

In yet another embodiment of the present invention, each of the unwinding devices is provided with a marking device.

The marking apparatuses are so arranged, that they are able, respectively, before the deposition of a further fabric band layer, to apply a marking on the existing band. The marking apparatuses are controllable in respect to time and position in such a way, that the markings of the finally stacked fabric layers are positioned congruently, one on the other. This pre-customized, multiple layered fabric band is then conducted to the cutting apparatus. On the now cutout patterns, the marking guides are still in alignment. The last marking apparatus (if there are more than one) is advantageously located between the last unwinding device and the custom cutting apparatus. It marks respectively the unwound fabric band layer from the assigned unwinding device before the next layer can be placed by the adjacently located unwinding device.

After the stacking and so that the markings of the individual layers are congruently aligned, the marking apparatuses and the withdrawal speed of the individual unwinders are time synchronized and controlled. Preferably, all marking apparatuses operate simultaneously, wherein each handles one window in the timely sequence of the fabric output. The marking windows can belong to one or to various cutout patterns. After the work-up of respectively one marking window, the fabric band is moved forward, so that the respective marking window next in line is presented. In regard to control, the marking windows are so synchronized, that in the finished, custom cut packet the marking lie congruently, one under the other. In the case of a discontinuous operation, the second marking apparatus carries onto the second layer of fabric exactly the same marking pattern, which, in a previous step, the first marking apparatus applied on the first fabric layer. The markings of the first and second material layers, lie congruent, one on top of the other. Alternatively, a continuous forward movement is possible. The fabric bands were, during the marking, pulled under the marking apparatuses.

Advantageously, the fabric custom cutting equipment is equipped with at least one coating material dispensing device placed after the unwinding device, which lays down a top layer on the fabric band. In this way, on the uppermost fabric band layer, a covering material is laid for the formation of a vacuum sealing means.

A fabric band with such a covering coating as described, upon later cutting, can, because of low pressure at the conveyor belt, be so pressed against the said conveyor belt, that the risk of a relative slipping of the single fabric band layers during the cutting is lessened. An appropriate covering material can be a plastic foil, a paper layer, or another foil-like material. The permeability to air of the covering material is advantageously less than that of the fabric band layers, so that a sufficient anchorage due to the vacuum formation is made. In the case of other embodiments, the suction is effected without a cover on the top fabric layer. A sufficient suction can be achieved by the relatively small air permeability of the fabric band layers to be cut.

In the case of more simple and more economical embodiments, the conveyor belt is provided with a rough and/or adhesive coating, which, without the vacuum effect is enabled to hold the fabric band(s) securely. This is accomplished advantageously by a felt coating. This obviates first, the relatively expensive suction arrangement and second, makes the coating of the fabric band obsolete.

In order to cut with greater precision and to hold the scrap rate to a minimum, there are various measures for freedom from folding in the depositing of the fabric on the conveyor belt or on other fabric layers. Thus, in yet another embodiment of the present invention, the progressive movement of the unwinding device or the fabric tension loading apparatus (which can be multiple) is somewhat slower than the forward motion of the conveyor belt. This causes the fabric to be laid on the conveyor belt with a certain degree of tension. In yet another embodiment of the present invention the fabric band is subjected to pressure, namely by a pressure roll which presses the band against the conveyor belt.

In the state of the technology, where custom cutting was involved, frequently in the edge areas of the pattern, so-called "clipping" was observed. What was involved here were three cornered cutouts, which indicated to the sewing person during the subsequent sewing of the fabric pattern, where the seams which were to be installed began or ended. In order to shorten the fabric work-up time even more, in yet another embodiment of the present invention the recognizable characteristic mark for seam ends or seam beginnings, instead of being marked with cutout "clips", such guiding markings are applied in the form of (colored) marking on the material itself. This is done advantageously by the above mentioned marking apparatus, which operates simultaneously with the custom cutting apparatus. Since the custom cutting apparatus is more heavily loaded than the marking apparatus, the substitution of the cutout clippings (optically recognizable) by markings would bring with it a more well balanced loading and therewith as a whole, an increase of profitable working time.

The marking system(s) can, advantageously, also be employed for other markings on the fabric pieces. Such markings, for instance, can be symbols assigning different fabric pieces to a specific, for instance, furniture piece. This is particularly valuable, when the fabric pieces belonging to a specific furniture piece come from different patterns. This would be the case if the furniture piece was to have a multicolored covering. Further such marking would be helpful if the fabric, because of roll end changes, was cut from an old and a new fabric roll. In yet another embodiment of the present invention, this assignment information, or other information can be carried out with the marking apparatus on an separate piece for sew-on addition. In this case a fabric piece is involved which is to be sewed on at a later time. The information can be presented in coded or uncoded form.

The fabric cutting equipment—alternatively or additionally—can possess a label application device, which provides the individual cutouts of a pattern or different patterns with labels, so that the cutouts, by further working, can be properly assembled together. The label application device can, for this service, be located either before or after the cutting apparatus and can be controlled by the complete system controller.

The unwinding device is advantageously designed as a rodless device, wherein the fabric rolls are found upon an underlying support, and for the unwinding of the fabric are set into rotation by a tangential motion imparted against their outer surface.

The fabric custom cutting apparatus can also possess a takeaway belt, which transports the already cut and possibly marked cutouts to various assigned receiving baskets. The take-away belts can also be located as an extension of the main conveyor belt.

Advantageously, the said fabric custom cutting apparatus also has a monitor, upon which the cutting design and/or the markings to be made are visible. As mentioned previously, in accord with the state of the technology, one employs separate equipment for the fabric feed and the custom cutting, which are assembled at the operating site. The above described arrangement of the fabric cutting apparatuses are also advantageous for such separate equipment, even if fully optimal results are not achieved, which optimal results would be expected of a fabric cutting apparatus designed as a unified entity. Existing in the textile working countries are a large number of such installations assembled from various parts and these are capable of useful production for many years to come. In order to allow these existing installations to enjoy the profitability of the invented designs, it is proposed that the custom cutting apparatus be retained, but to replace the feeding apparatus with a fabric forwarding feed system in accord with one or more of the above assemblies. In yet another embodiment of the present invention, such a fabric feeding device and system is proposed with at least one fabric unwinding device for a fabric roll, one belt conveyor for the transport of the unwound fabric, wherein the unwinding device lays the fabric band directly on the conveyor belt or upon one or more fabric bands already thereon, whereby the fabric feed equipment possesses one or more of the features of the fabric feed equipment found in the embodiments of the present invention previously described. Insofar as a fabric custom cutting apparatus is mentioned, the separate custom cutter component is not excluded from within the meaning of the term. In some cases, the separate custom cutter component can be controllably coupled with the fabric feed equipment of the invention, so that, for instance, the object of defining and operating on the cut out patterns prior to the end of the fabric roll is advantageous to the highest degree with the feed apparatus of the invention along with an existing, conventional custom cutting apparatus. Particularly advantageous is yet another embodiment of the present invention in which a multi-layered marking is made possible. From this, the existing cutting system can profit in the greatest measure if it is operated together with a feed system as outlined above.

Finally, the invention presents a procedure for custom cutting of fabric, including the steps of laying out at least one layer of a fabric on a conveyor belt by the unwinding of a roll of fabric from an unwinding device and directing deposition on the continuing or discontinuing movable conveyor belt or on one or more layers of fabric already deposited thereon, transporting the laid out fabric on the conveyor belt to a custom cutting apparatus and automatic cutting out of a desired pattern form with the custom cutting apparatus. In accord with one or more of the above formulations, the procedure can be developed and extended whereby the conveyor belt is continuous at least from the fabric deposition point to the operating area of the custom cutting apparatus. In regard to the details reference is made to explanations for fabric cutting and fabric transport, which give attention to the process and its embodiments.

Other objects and features of the invention will become apparent as the description proceeds, especially when taken in conjunction with the accompanying drawings illustrating the invention, of which there are eight sheets of four embodiments.

BRIEF DESCRIPTION OF THE DRAWINGS

In the drawings, the same reference number is given to components with identical functions or definitions.

DESCRIPTION OF THE PREFERRED EMBODIMENTS

Figure 1:
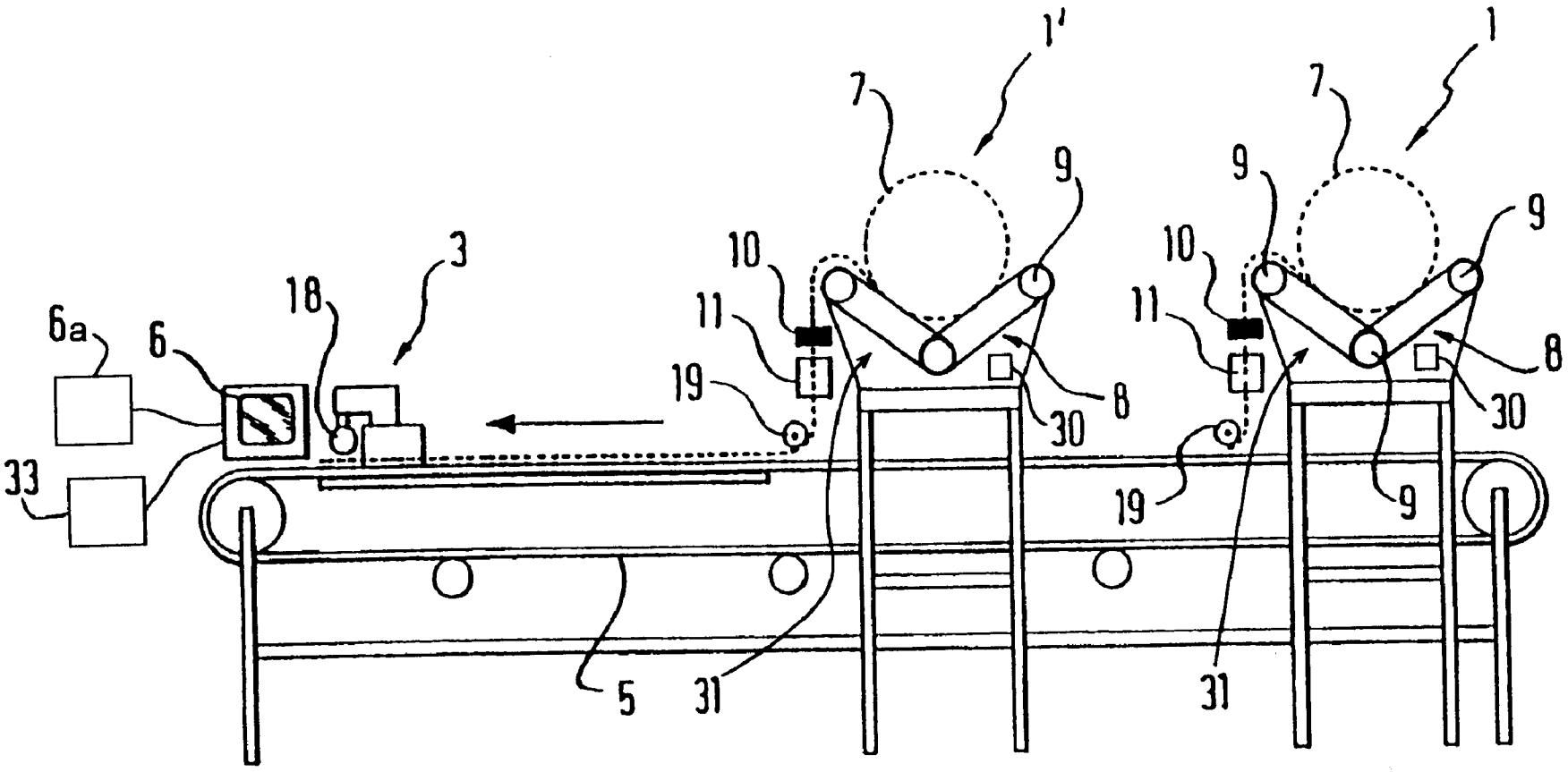
FIG. 1 is a side view of a fabric custom cutting apparatus with two unwinding devices, however, without a marking apparatus.
Figure 2:
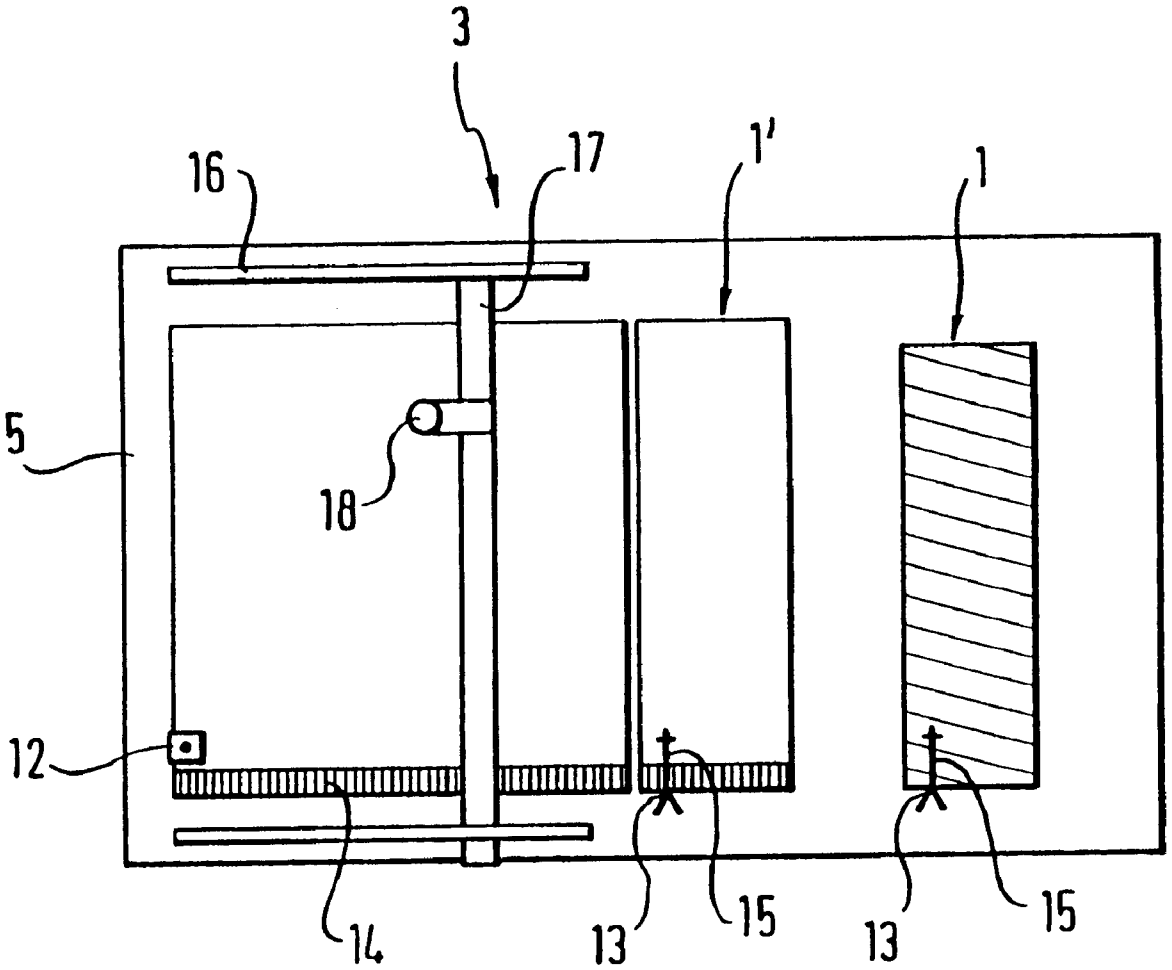
FIG. 2 is a plan view of the cutting apparatus of FIG. 1.

The fabric custom cutting apparatus, as shown in FIGS. 1, 2, exhibit two unwinding devices 1, 1'. Respectively, a fabric roll 7 lies in a V-notch shaped, belt arrangement 8 of the unwinding device, which latter has three rolls 9. The belts are driven preferably by means of the center roll 9. The traveling force of the said belt arrangement 8 is communicated by friction to the fabric rolls 7, which are thereby rotated and unwind themselves.

The fabric custom cutting apparatus is equipped with a conveyor belt 5, which extends itself from the position where the fabric from the first unwinding device 1 is laid down to the operational area of the custom cutter 3. As to the term "first unwinding device", that unwinding device is to be understood which is most remote from the said custom cutting apparatus 3. The fabric band is laid down from the unwinding devices 1, 1' directly upon the conveyor belt 5. The direction of travel of the progressing conveyor belt is characterized in the drawing(s) by an arrow.

In accord with the presentation in FIG. 1, the second unwinding device 1' is active. The first unwinding device is idle. The custom cutting apparatus 3, accordingly, cuts fabric which is respectively discontinuous by the length of a cutting window as drawn from the fabric roll 7 of the second unwinding device 1'.

The unwinding devices 1, 1' are respectively equipped with a fabric-end sensor 30. This is comprised, for example, of a light emitter/receiver unit and a reflector. This light relay unit can be so arranged, that the light beam runs over the two outer rolls 9 of the belt arrangement 8, so that the fabric rolls interrupt the light path of the light relay. When the diameter of the fabric roll, on the other hand, reduces itself below a given threshold, the light beam passes freely to the receiver, thus making a fabric end signal to a control instrument 6*a* This signal initiates a cutoff of the fabric band already on the conveyor from the remainder wound on the fabric roll 7. At this point, the fabric band is retained by a tensioner apparatus 10 and is cut off by a subsequently placed fabric cutoff apparatus 12. Both the tensioner 10 and the cutoff apparatus 12 are installed on the unwinding device 1, 1' in an area in which the already unwound fabric has not yet reached the conveyor belt 5. After the cutoff, the fabric remainder on the second fabric roll 1' (the active roll) is rewound thereon.

Although the end of the fabric band, now laid upon the conveyor belt 5, is to be cut by the custom cutting apparatus 3, the first unwinding device 1 is already unloading onto the same conveyor belt 5. With a doubled belt advancement, the fabric from the first unwinding device 1 is already within the operational area of the custom cutting apparatus 3, so that a fabric roll switch is achieved with only a small break in the continuous operation. The operating person can now remove the fabric roll from the second unwinding device 1' and replace it with a new fabric roll.

For the continuing of the cutting procedure with the new material, a zero point positioning is required. In the progressive direction of the conveyor belt, this zero-point setting is fully automatic since a travel-direction, zero point sensor 11 detects the forward edge of the fabric in the operational area of the custom cutting apparatus. The detection is based on an optical recognition of the color of the fabric which differs from the color of the conveyor belt and/or by means of an optical detection of a spatial difference between fabric bands. In the cross direction, the zero point setting occurs half-automatically. And indeed, the unwinding devices 1, 1' are slidable at right angles to direction of belt travel by means of a cross directed drive 31. This cross drive is equipped with a subsequent signal controller 33, which, acting upon a signal from the optical fabric band edge sensor, moves the unwinding roll laterally so that the unwound fabric band edge comes to a constant cross position on the conveyor belt. This avoids that an uneven unwinding of the fabric leads to angled pushing of the laid down fabric band on the conveyor belt. The position of the unwound fabric located across the belt, which was automatically set by the follow-up control, can be adjusted in individual cases by an operating person as fabric rolls are changed. This is necessary, since the breadth of the so called fabric band edge 13, does not coincide from side to side. For this adjustment there serves a determinable cross directional zone (14), i.e. selvedge, free of zero point.

The cross directional zero point adjustment also encompasses the fact that the operating person, after the insertion of a new roll of fabric, sets the zero point at a specified spatial offset (for instance 1 cm) inside of the inner selvedge limit. By this means, assurance is given, that the cross directional drive automatically controls the position of the unwinding devices 1, 1' in such a manner, that the adjusted cross zero point is always laid at the same cross position of the conveyor belt.

This cross zero point adjustment can be undertaken previous to the actual start of operations of a unwinding device and so would engender no interruption in the continuity of work.

The custom cutting apparatus 3 encompasses a sliding support 16, movable parallel to the conveyor belt, possessing a cross-traverse 17 upon which a cutting head 18 is movable. Where the cutting head 18 is concerned, this could be, among other choices, a laser-cutting head.

The control equipment has stored in memory, the patterns to be cut. On a monitor 6, (among other things) these patterns are presentable in virtual cutouts. Using these the stored patterns as a basis, the control equipment controls:

- the remnants from the unwinding devices 1, 1',
- the automatic relocation of the zero points in belt travel direction,
- the motion of the cutting head 18 in belt travel and cross directions,
- the cutting activity of said cutting head 18,
- the cutoff of the fabric at approaching roll end, and
- the exchange from one unwinding device to the other because of input from the cutting specification for a change in from one fabric to another or because of an approaching end of a fabric band.

More detail on this will be provided below in connection with FIGS. 5, 6.

A fold-free lay-out of the fabric on the conveyor belt 5 is to be achieved, first, in that the tensioning device 10 for stretching the fabric permits only a somewhat lesser forward motion of the fabric in comparison to that of the conveyor belt 5. Thereby, the fabric is under a certain tension when laid down on the conveyor belt 5.

Second, proximal to each unwinding device, 1, 1', a pressure rider roll 19 is provided, which presses the fabric against the conveyor belt 5.

The said conveyor band 5 is provided with a felt like surface. The fabric clings to the material of this surface so well, that it does not slide even during the cutting process.

Figure 3:
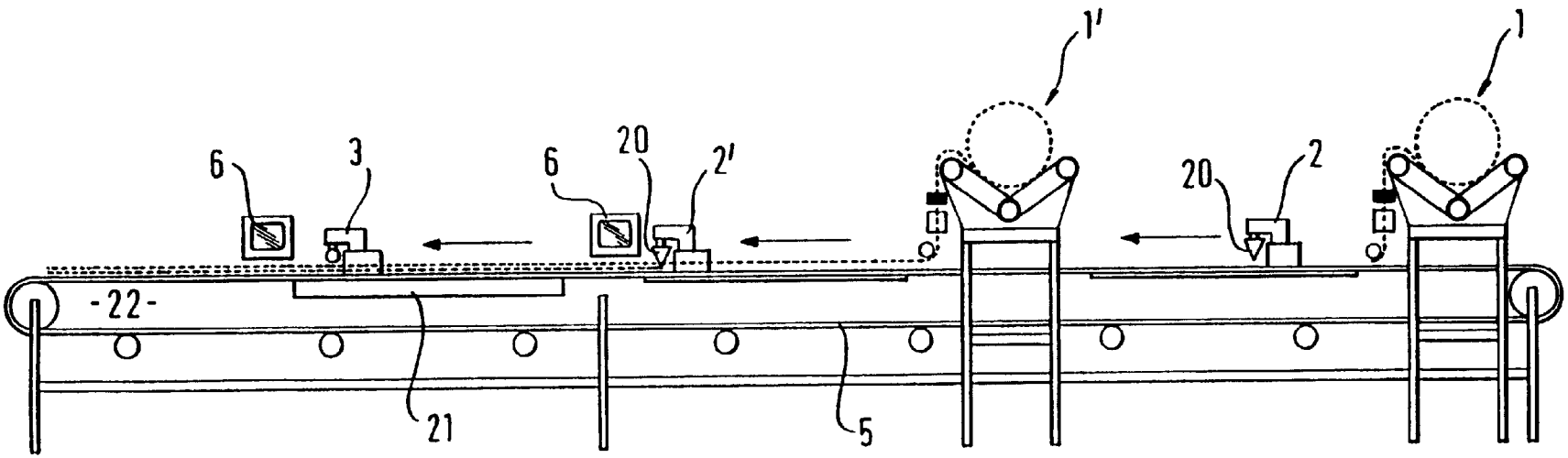
FIG. 3 is a side view of a fabric custom cutting apparatus, similar to FIG. 1, however with the additional equipment of two marking apparatuses and a removal belt.
Figure 4:
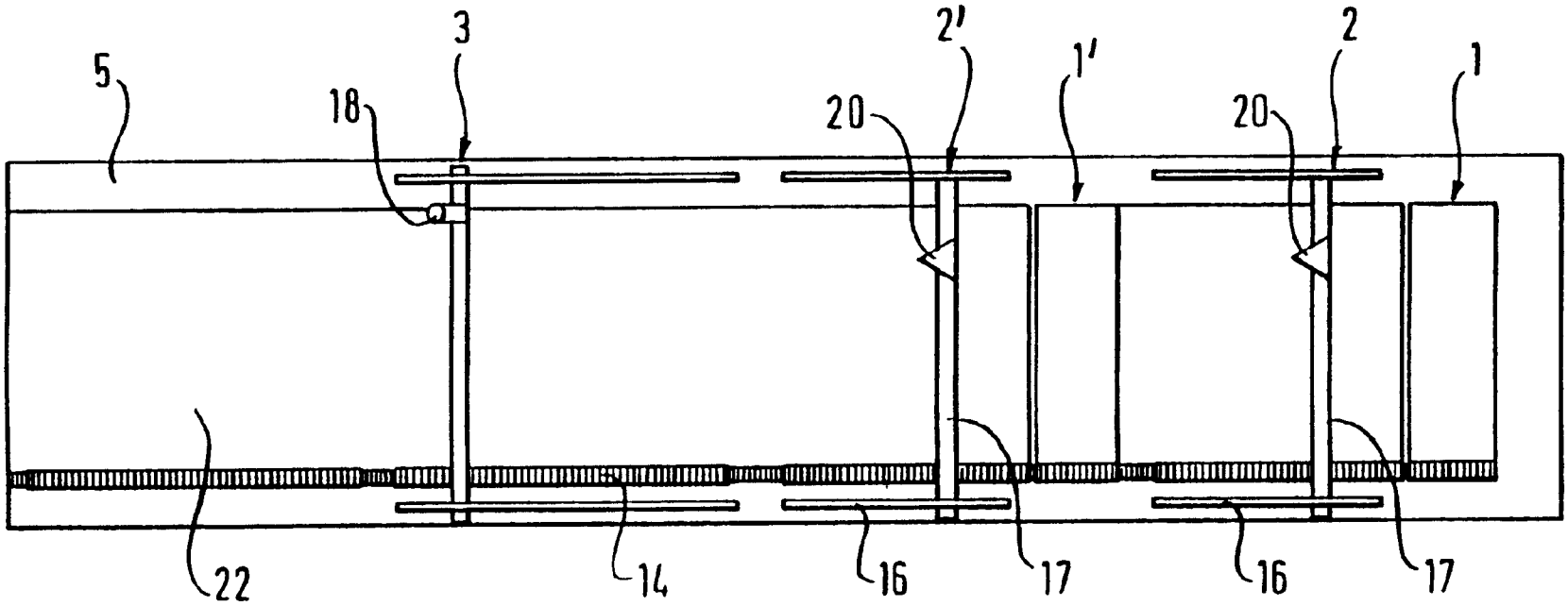
FIG. 4 is a plan view of the fabric cutting apparatus shown in FIG. 3.

The fabric custom cutting in accordance with FIGS. 3, 4 permit the marking and the cutting of multi-layer fabric bands. The above detailed explanations for the FIGS. 1 and 2 are also valid for such multi-layer bands in the same custom cutting apparatuses. Additionally, on the cutting apparatus, after each unwinding device 1, 1' is found respectively, a marking apparatus 2, 2' which applies on the just unwound fabric band, line markings for quilting or sewing to be carried out later. The marking are comprised, for instance of a self volatilizing substance, which can only be seen in ultraviolet or infrared spectrums. The marking apparatuses 2, 2', correspond in construction to the above described custom cutting apparatus 3, and indeed, they exhibit a support 16, slidingly movable parallel to the conveyor belt carrying a traverse bar 17 and a marking head 20 thereon. The latter is, for instance, a spray head which ejects the marking substance in the course of the spray head movement and thereby applies line-like markings of optional line form in the fabric.

After the first layer of the fabric band is laid down by the first unwinding device 1, has been marked by the first marking apparatus, and has been transported further by the conveyor belt 5, then the second unwinding device 1' lays down a second layer of fabric. This will be marked by the second marking apparatus 2'. The marking procedure is so controlled, that at the end of the marking, the markings on successive layers of fabric band are congruent. The conveyor belt transports the ready-to-cut, multilayer fabric band to the custom cutter apparatus 3, where the collected layers are cut in a common operation.

A vacuum box 21 in the operational area of the custom cutting apparatus 3, located underneath upper strand of the endless conveyor belt sucks air through the conveyor belt and the superimposed fabric bands. This causes a sufficient compression of the fabric bands onto the conveyor band to exclude any slippage of same during the cutting operation.

On the monitor 6, in this embodiment, not only the virtual cutout lines are visible, but also the marking lines.

Behind the custom cutting apparatus 3—"downstream", relative to the belt travel—is appended a removal belt 22, which is formed from an extended portion of the conveyor belt 5. By means of said removal belt 22, either the finished cut out fabric pieces can be sorted by the operational persons, or an automatic arrange and sort system can be added. Also, at this point, error cuts can be sorted out.

Figure 5:
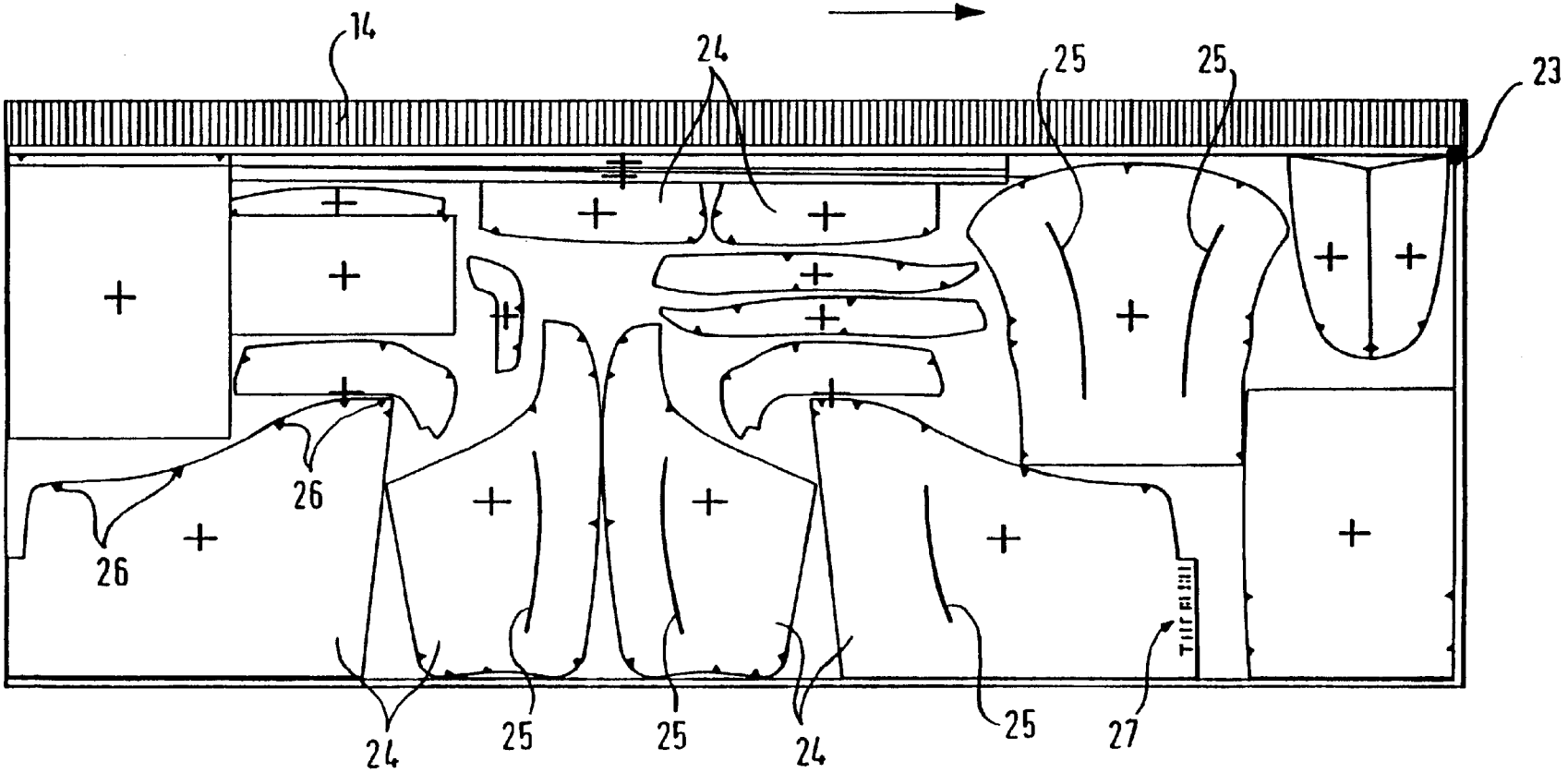
FIG. 5 is a schematic presentation of a fabric band with pattern cutouts and blanks to be cut.

FIG. 5 shows a fabric band ahead of the custom cutting. On the longitudinal edge, is found the selvedge 14, which normally has a width of 2 cm. The (virtual) zero point 23 finds itself in a cross direction, somewhat inside of the inner edge of said selvedge 14 (about 0.2 mm), as well as in the direction of travel of inside of the forward fabric edge (for instance, about 1 cm). On the fabric are seen the cutting lines of the patterns 24 yet to be cut out. This presentation of the lines serves only for information, because in reality, the lines are virtual, and exist only in the data memory of the cutter control. Along these virtual cutting lines, is moved the marking head 20 of the custom cutting apparatus 3, so that said custom cutting apparatus 3 excise the presented cutouts. Likewise, marking lines 25 are drawn in. These are first likewise in the memory of the control equipment, but after the application of the markings, however, they become visible on the fabric in the here presented form. In the area of the cutting lines, also triangular markings 26 are to be seen. These are likewise applied by the marking apparatus 2, 2'. The triangular marking serve for the later work-up of the fabric as recognition signals for seam ends or seam beginnings. Finally, the marking apparatus 2, 2' sprays in the specified seam locations of the cutouts 24, data 27 such as commission or cutout number, so that after the cutting, an assignment of the single cutouts to their proper place is made easier.

When the length of a cutting pattern, as is presented, for example, in FIG. 5 exceeds the length of the working range of the custom cutter 3, then the virtual cutting pattern is apportioned into several virtual parts, which correspond to the workable lengths. The control of the equipment is so designed, that after a progressive movement of the conveyor belt to the extent of the length of a "cutting window", to allow that the next window to be processed, the result is that the presented cutting pattern shown in FIG. 5 is cut piecewise.

Figure 6:
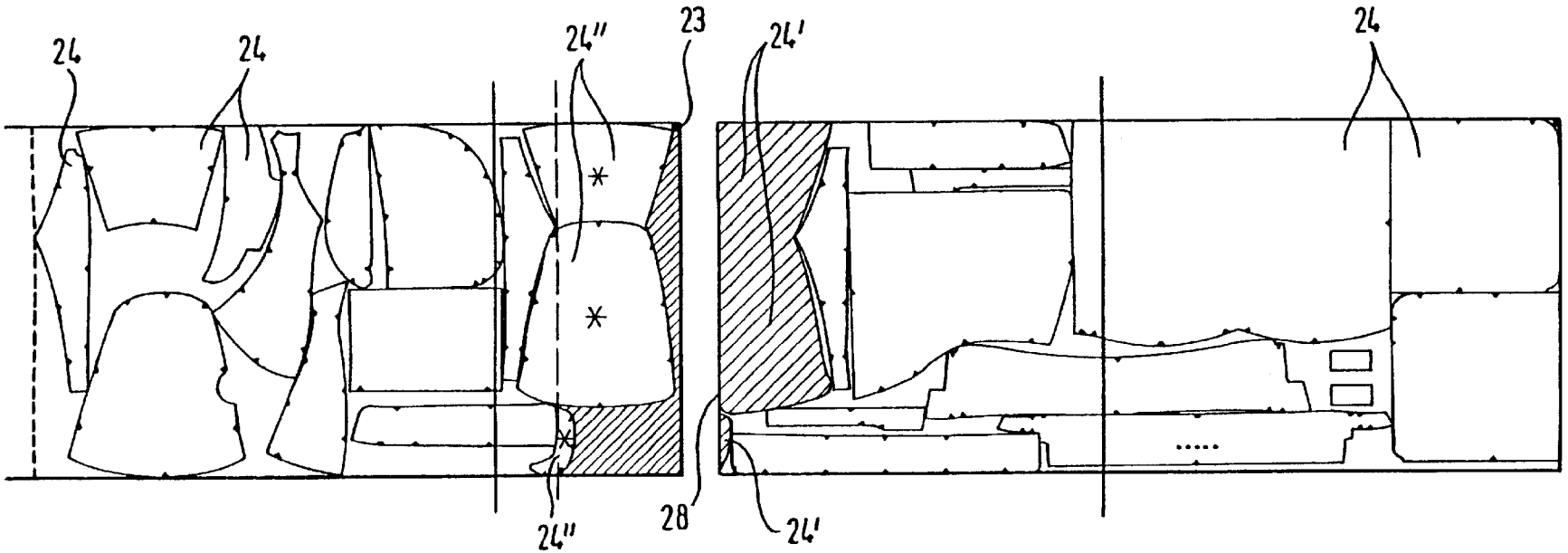
FIG. 6 is a schematic cutout, the patterns for which were divided onto two separate fabric bands.

FIG. 6 shows a pattern for cutting in an apportionment to demonstrate three cutting windows. In the presented example, the fabric band end comes to lay in the middle of the center cutting window. The control of the equipment determines immediately, which of the virtual proposed cutouts can be made from this cutting window in their entirety, and for which this is not the case. The control then allows the cutting of the partial cutout 24' from the fabric band which is coming to its end, and allows, from the next new fabric band, the excising of the cutout 24" which is now an incomplete but complementary cutout to 24'. Previously, the control had automatically reset the zero point 23 on the new fabric band. This measure allows, that the scrap waste is reduced to the minimum and upon fabric band change work can continue, practically without interruption.

Figure 7:
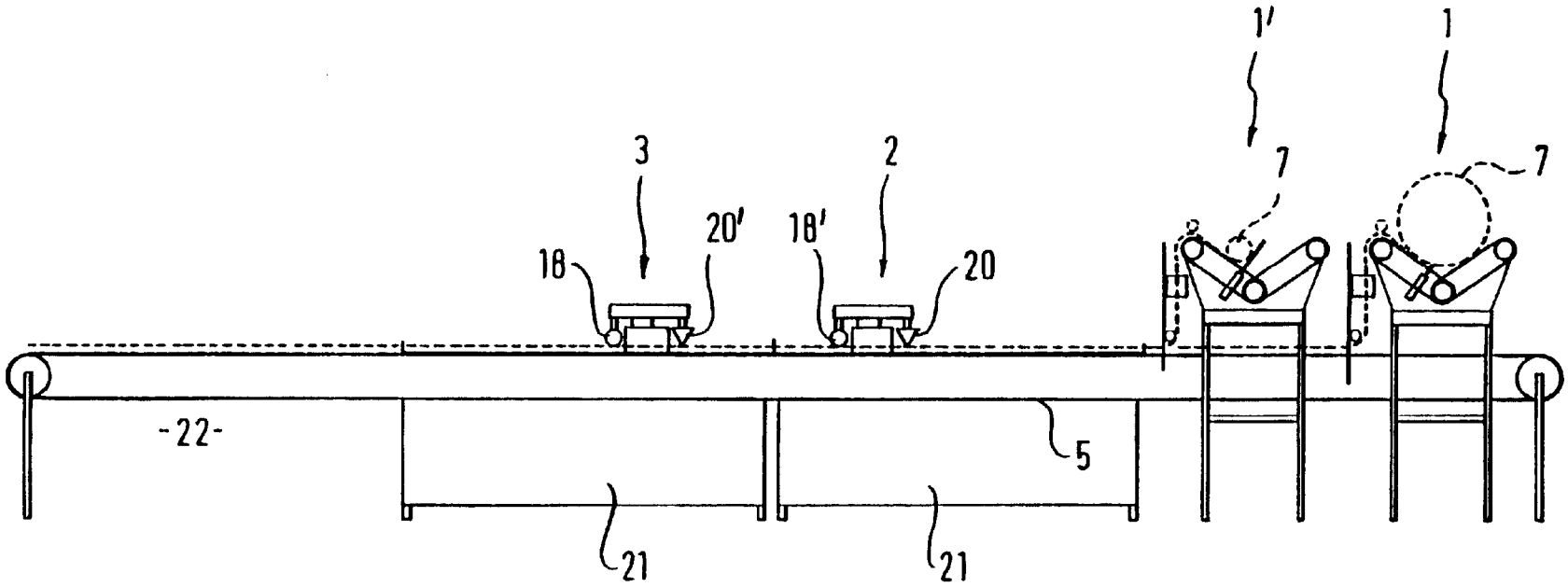
FIG. 7 is a side view of a fabric custom cutter apparatus which is similar to FIG. 1, which is made secure against down time due to loss of the cutting facility and the marking apparatus.

The demonstrated fabric custom cutting equipment is modular in its construction. Thereby, components other than those here presented in example embodiments, may in a simple way, be used in combination with other functional units. Particularly advantageous is, for example, an embodiment for single layer fabric working, similar to FIG. 1, which, however, possesses behind the second unwinding device, 1', a marking apparatus of the kind shown and described in FIG. 3. Such an embodiment is shown in FIG. 7. With this embodiment, single layer marking and custom cutting can be carried out, whereby, because of the doubled unwinding devices available, and the simultaneous carrying out of the marking and cutting, very high speed operation can be achieved. The fabric cutting apparatus of FIG. 7 corresponds to the remaining, not mentioned features in the FIGS. 1 to 4.

Other than shown in FIGS. 3, 4, by an increase in durability and resistance against downtime, the marking apparatus 2 (where more marking apparatuses are present, then as in FIGS. 3, 4—the last marking apparatus) is provided with a cutting head 18'. Correspondingly, the custom cutting apparatus 3 is equipped with a marking head 20'. Respectively, a vacuum box is found in the working areas of the marking and cutting apparatuses.

In normal operation the additional heads 18' and 20' are not employed. In case of a breakdown of one of the normally used heads 18, 20, then, respectively, one of the additional heads 18', 20' is put to use. Now as to the roll exchange: The custom cutting apparatus 3 takes over the marking operation, the marking apparatus the cutting. In this emergency switching operation, the marking continues after the cutting, the already cutout pieces of fabric are also marked. Because of the before and after simultaneous method of operation, the operational speed can be maintained at its normal level. In the case of a total breakdown, a further emergency run stands available for the custom cutting apparatus 3 and the marking apparatus 2. The emergency operation is as follows:

The still operable apparatus 2 or 3, by the activation of the marking head 20' or the cutting head 18', marking and cutting now are done one after the other. The equipment can then, in spite of total breakdown, still operate, whereby, because of the now no longer simultaneous method of operation, the working speed is diminished.

Figure 8:
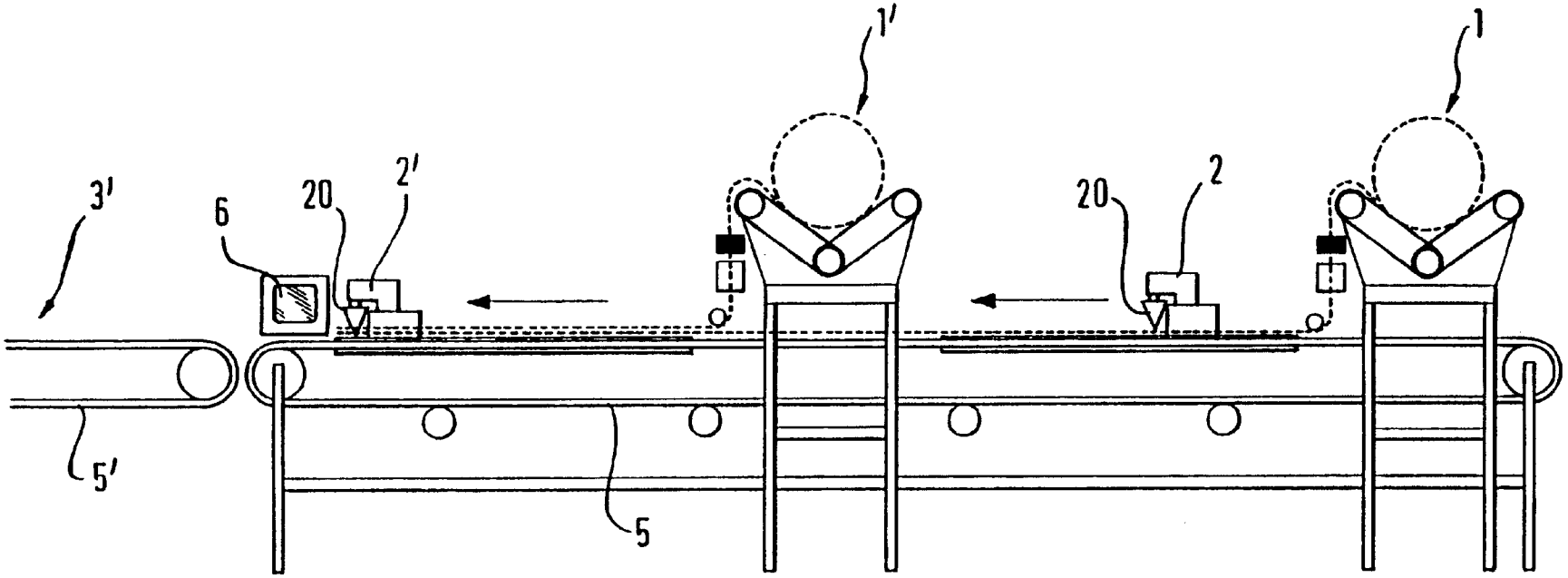
FIG. 8 is a side view of a fabric unwinding device, which is similar to that of FIG. 3, however, not equipped with a custom cutting apparatus.

FIG. 8 shows a fabric feed apparatus, which corresponds to that presented in FIG. 3 with the custom cutting apparatus. The single difference therefrom is that this embodiment has no custom cutting apparatus 3 (and also no subsequent removal area 22). Much more, the conveyor belt 5 ends in this case directly after the last marking apparatus 2'. This depicted arrangement in FIG. 8 is designed to be combined with a separate (partially shown in the FIG. 8) custom cutting apparatus 3', which has its own conveyor belt 5'. Composite embodiments to the FIG. 1 through 7 are adaptable also for this fabric feed equipment. The shown embodiment permits, as does that of FIG. 3, a collection of multilayer, marked fabric windows, before the cutouts are excised in common from the fabric band packet.

What is claimed is:

1. A fabric custom cutting apparatus comprising:

at least two fabric unwinding devices, each fabric unwinding device operable to unwind fabric from a fabric roll and rewind unwound fabric back onto the roll, each device including a fabric cutoff apparatus;

a conveyor belt for transporting unwound fabric from the roll, each fabric unwinding device arranged to deposit unwound fabric directly on the conveyor belt at a point of deposition on the conveyor belt, said fabric unwinding devices arranged along the conveyor belt such that the respective points of deposition of the fabric unwinding devices are spaced from each other along the conveyor belt; and a custom cutting apparatus for cutting out a pattern figure from unwound fabric laid on the said conveyor belt;

said conveyor belt extending continuously from the points-of deposition of unwound fabric from the unwinding devices to the custom cutting apparatus; and control means connected to said fabric unwinding devices and responsive to a cutoff of a fabric band by the fabric cutoff apparatus of one of the at least two fabric unwinding devices from fabric unwound from a first fabric roll by the one of said fabric unwinding devices to rewind the first fabric roll by the one of said fabric unwinding devices and unwind fabric from a second fabric roll by another of said at least two fabric unwinding devices;

whereby a fabric roll change is achieved without loss of, or only with minimal loss of, production time.

2. The fabric custom cutting apparatus of claim 1 wherein said control means is operable to automatically rewind the first fabric roll by the one of said fabric unwinding devices after cutoff of the fabric band by the fabric cutoff apparatus of the one of said fabric unwinding devices.

3. The fabric custom cutting apparatus of claim 1 wherein said control means comprises means for establishing a zero point setting in a travel direction along the conveyor belt for an ensuing cutting operation by the custom cutting apparatus, said control means operable to automatically detect the arrival of a leading end of unwound fabric on the conveyor belt at a predetermined point proximal to the custom cutting apparatus, and upon such detection establish the zero point setting in the travel direction of the unwound fabric.

4. The fabric custom cutting apparatus of claim 1 wherein the custom cutting apparatus includes a cutting head and said control means comprises means for positioning and controlling the cutting activity of the cutting head.

5. The fabric custom cutting apparatus of claim 1 further comprising at least one of a) and b):

a) a suction apparatus arranged to apply suction to unwound fabric conveyed on the conveyor belt whereby the unwound fabric on the conveyor belt is pressed against the conveyor belt, and b) the conveyor belt having in contact with the unwound fabric conveyed on the conveyor belt at least one of: a rough surface, an adhesive covering and a felt surface.

6. The fabric custom cutting apparatus of claim 1 comprising one of a pressure device or a pressure roller located along said conveyor belt between said points of deposition and said custom cutting apparatus wherein unwound fabric conveyed on the conveyor belt is pressed against the conveyor belt by said pressure device or pressure roller whereby the pressed fabric lays out fold-free on the conveyor belt.

7. The fabric custom cutting apparatus of claim 1 comprising at least one marking apparatus configured to apply recognition symbols for seam ends or seam starts on unwound fabric being conveyed on said conveyor belt.

8. The fabric custom cutting apparatus of claim 1 further including means for applying data in coded or uncoded form on the unwound fabric.

9. The fabric custom cutting apparatus of claim 1 wherein each fabric unwinding device includes a fabric tensioner apparatus for retaining fabric to be cut off by the fabric cutoff apparatus.

10. The fabric custom cutting apparatus of claim 9 wherein each fabric unwinding device advances unwound fabric at the deposition point of each unwinding device at a first respective speed and said conveyor belt advances fabric on the belt at a second speed, the second speed being greater than each of the respective first speeds so that a substantially fold-free layout of the unwound fabric on the conveyor belt is achieved.

11. The fabric custom cutting apparatus of claim 1 wherein each fabric unwinding device is located a respective distance from the custom cutting apparatus and said conveyor belt has a conveying speed; and said control means is connected to said custom cutting apparatus and as operable after the cutoff of the fabric band by the fabric cutoff apparatus to calculate an arrival time of a trailing end of the fabric band at the custom cutting apparatus from data representing the speed of the conveyor belt and the distances of the fabric unwinding devices from the custom cutting apparatus and to interrupt fabric cutting by the custom cutting apparatus at the calculated arrival time, of the trailing end of the fabric band at the custom cutting apparatus.

12. The fabric custom cutting apparatus of claim 11 wherein the control means is operable upon a resumption of the unwinding of fabric by one of the fabric unwinding devices to calculate automatically from said data the time of arrival of a leading end of the unwound fabric from the fabric unwinding device at the custom cutting apparatus and to resume an interrupted cutting of fabric by the custom cutting apparatus at the calculated arrival time of the leading end of the unwound fabric at the custom cutting apparatus.

13. The fabric custom cutting apparatus of claim 1 wherein each fabric unwinding device further comprises:

a sensor configured to detect a position relative to said sensor of a transverse edge of unwound fabric from the fabric roll being unwound by the fabric unwinding device;

a cross drive for transversely sliding the fabric roll being unwound by the fabric unwinding device; and a follow-up device which automatically actuates said cross drive in response to the position of the fabric edge detected by the sensor to maintain a constant position of the fabric edge so that the fabric edge is brought to lie in a predetermined transverse position to compensate for fabric rolls having selvedges of differing width or irregular unwinding of fabric from the roll.

14. The fabric custom cutting apparatus of claim 13 wherein each sensor includes a light-relay comprising one or more light sources which illuminate the fabric edge of the unwound fabric and one or more sensors for spatial detection of the light either interrupted by such unwound fabric or falling on such unwound fabric.

15. The fabric custom cutting apparatus of claim 1 wherein each fabric unwinding device comprises means for recognizing substantial complete unwinding of the fabric roll, said conveyor belt has a conveyor speed, and said control means is connected to said custom cutting apparatus, said control means further comprising:

storage means for storing a plurality of cutouts of a cutting pattern;

said control means being responsive to said recognition means for determining from data representing the speed of the conveyor belt and a recognition of the substantially complete unwinding of a fabric roll which cutouts of the cutting pattern are completely cut out by the custom cutting apparatus before reaching an end of the fabric band from the fabric roll and which cutouts are to be cut by the custom cutting apparatus from fabric unwound from another roll, storing the cutouts that are to be cut from the fabric unwound from the other roll and deferring the cutting of such stored cutouts until the fabric unwound from the other roll is conveyed to the custom cutting apparatus.

16. The fabric custom cutting apparatus of claim 15 wherein said control means is. operative to determine which cutouts of the cutout pattern are only partially cut out by the custom cutting apparatus before reaching the end of the fabric band from an unwound fabric roll, apportioning each of such cutouts into a first portion to be cut from the fabric band at the custom cutting apparatus and a second portion to be cut from fabric unwound from another fabric roll, storing such second portions to be cut from the other roll, automatically resetting a zero point in a direction of belt travel of the fabric unwound from the other roll, and directing said custom cutting apparatus to cut such second portions from the fabric unwound from the other roll.

17. The fabric custom cutting apparatus of claim 1 wherein each fabric unwinding device includes a fabric end sensor for detecting substantial complete unwinding of the fabric roll by each of the fabric unwinding devices.

18. The fabric custom cutting apparatus of claim 17 wherein each fabric end sensor comprises a light-relay having a light path, each of the at least two fabric unwinding devices being configured to locate an unwound portion of the fabric roll being unwound by each of the fabric unwinding devices in the light path of the fabric end sensor of each of the fabric unwinding devices, whereby the light path is blocked by the unwound portion of the fabric roll when the fabric roll is not substantially completely unwound and the light path is not blocked by the fabric roll when the fabric roll is substantially completely unwound.

19. The fabric custom cutting apparatus of claim 17, wherein said control means is operable after the detection of the substantially complete unwinding of the fabric rolls by the fabric end sensors of each of the fabric unwinding devices to initiate the cutoff of the fabric band with the fabric cutoff apparatus of (such fabric unwinding devices.

20. The fabric custom cutting apparatus of claim 1 wherein said conveyor belt is beneath each of the at least two fabric unwinding devices.

21. The fabric custom cutting apparatus of claim 20 comprising a marking apparatus for applying markings onto unwound fabric conveyed on said conveyor belt, said marking apparatus located along said conveyor belt between each of said points of deposition and said custom cutting apparatus.

22. The fabric custom cutting apparatus of claim 21 wherein said conveyor belt defines a downstream direction from said points of deposition to said custom cutting apparatus and an opposite upstream direction;

said at least two fabric unwinding devices comprise a first fabric unwinding device and at least one second fabric unwinding device, each of said at least one second fabric unwinding devices spaced along said conveyor belt a respective distance upstream from said first fabric unwinding device;

said fabric custom cutting apparatus further comprises at least one additional marking apparatus; and each additional marking apparatus is associated with a respective one of said at least one second fabric unwinding devices to mark fabric unwound from a fabric roll by said respective fabric unwinding device and is between said respective second fabric unwinding device and a next adjacent downstream first or second fabric unwinding device.

23. The fabric custom cutting apparatus of claim 1 further comprising at least one marking apparatus for applying markings for seams or quilting onto the unwound fabric carried on the conveyor belt.

24. The fabric custom cutting apparatus of claim 23 wherein each of the at least one marking apparatus includes a marking head movable along two mutually perpendicular axes, a position of each marking head being controllable by said control means, said control means capable of receiving data representing a desired movement of the marking head and moving the marking head in accordance thereto.

25. The fabric custom cutting apparatus of claim 23 wherein the said at least one marking apparatus is located and controlled separately from the custom cutting apparatus and the said at least one marking apparatus and the said custom cutting apparatus are configured to operate substantially simultaneously.

26. The fabric custom cutting apparatus of claim 25 further including a combined marking apparatus and custom cutting apparatus unit, the combined unit including said custom cutting apparatus or an additional custom cutting apparatus; and said control means comprising means operable upon a failure of the marking apparatus or the custom cutting apparatus to actuate the marking apparatus or custom cutting apparatus of the combined unit so that the combined unit performs the function of the failed apparatus.

27. A procedure for the custom cutting of fabric comprising the steps of:

(a) unwinding fabric from a first fabric roll at a first unwinding location;

(b) conveying the fabric unwound from the first roll to a custom cutting apparatus;

(c) cutting pattern figures from the conveyed fabric with the custom cutting apparatus;

(d) cutting off an end of the fabric unwound from the first a fabric roll and rewinding a fabric remnant onto the first fabric roll;

(e) unwinding fabric from a second fabric roll at a second unwinding location spaced from the first unwinding location after the fabric ban has been cut off from the first fabric roll and while the first roll remains at the first unwinding location; and (f) conveying the fabric unwound from the second fabric roll to the custom cutting apparatus.

* * * * *